US007701344B2

(12) United States Patent
Mattice et al.

(10) Patent No.: US 7,701,344 B2
(45) Date of Patent: Apr. 20, 2010

(54) RADIO DIRECTION FINDER FOR GAMING CHIP AND/OR PLAYER TRACKING

(75) Inventors: Harold E. Mattice, Gardnerville, NV (US); Chris Gadda, Las Vegas, NV (US); Chan Griswold, Reno, NV (US); James Stockdale, Clio, CA (US); Richard Wilder, Sparks, NV (US)

(73) Assignee: IGT, Reno, NV (US)

( * ) Notice: Subject to any disclaimer, the term of this patent is extended or adjusted under 35 U.S.C. 154(b) by 378 days.

(21) Appl. No.: 11/726,633

(22) Filed: Mar. 21, 2007

(65) Prior Publication Data

US 2008/0231457 A1 Sep. 25, 2008

(51) Int. Cl.
*G08B 13/14* (2006.01)

(52) U.S. Cl. ..... 340/572.1; 340/572.4; 340/572.7; 340/572.8; 340/539.13; 340/539.26; 273/237; 273/288; 273/309; 463/13; 463/25; 463/29; 463/47; 235/375; 235/385; 235/492

(58) Field of Classification Search ..... 340/572.1, 340/572.4, 572.7, 572.8, 539.13, 539.26; 273/237, 288, 309; 463/13, 25, 29, 47; 235/375, 235/385, 492

See application file for complete search history.

(56) References Cited

U.S. PATENT DOCUMENTS

| | | | | |
|---|---|---|---|---|
| 5,651,548 | A * | 7/1997 | French et al. | 463/25 |
| 6,046,683 | A | 4/2000 | Pidwerbetsky | |
| 6,514,140 | B1 * | 2/2003 | Storch | 463/25 |
| 6,923,724 | B2 | 8/2005 | Williams | |
| 7,116,987 | B2 | 10/2006 | Spain, Jr. et al. | |
| 7,116,988 | B2 | 10/2006 | Dietrich et al. | |
| 2005/0054439 | A1 | 3/2005 | Rowe et al. | |
| 2006/0076401 | A1 | 4/2006 | Frerking | |

(Continued)

FOREIGN PATENT DOCUMENTS

| | | |
|---|---|---|
| WO | 03/032240 | 4/2003 |

OTHER PUBLICATIONS

International Search Report and Written Opinion for PCT/US2008/057247, mailed Oct. 8, 2008.

(Continued)

*Primary Examiner*—Tai T Nguyen
(74) *Attorney, Agent, or Firm*—Weaver Austin Villeneuve & Sampson LLP

(57) ABSTRACT

Various techniques are disclosed for facilitating tracking locations of players and/or wireless communication devices in a casino network. In at least one embodiment, an electronically switched Doppler antenna array may be utilized to detect a first wireless signal from a first signal source. Bearing information may be generated using information from the detected signal. In at least one embodiment, the bearing information may include a first directional bearing to the first signal source. Using at least a portion of the first bearing information, a first location of the first signal source may be determined. According to specific embodiments, the first signal source may correspond to a wireless communication device such as an RFID-enabled player tracking card or gaming chip. In at least one embodiment, a current location of the wireless communication device may be automatically tracked in real-time as the wireless communication device is moved through a first region of the casino.

39 Claims, 6 Drawing Sheets

U.S. PATENT DOCUMENTS

2006/0258442 A1 11/2006 Ryan
2007/0035399 A1* 2/2007 Hecht et al. ..... 340/572.1

OTHER PUBLICATIONS

Japanese Office Action for 2004-526237 mailed Dec. 29, 2008, English Translation.
Converting Signal Stringth Percentage to dBm Values, Joe Bardwell, Nov. 2002.
Doppler Direction Finder, Radio Direction Finder Kit, Ramsey Electronics Mode No. DDF1, Copyright 1998 by Ramsey Electronics, Inc.
N. Patwari, A. O. Hero and J. Costa, "Learning Sensor Location from Signal Strength and Connectivity," in Secure Localization and Time Synchronization for Wireless Sensor and Ad Hoc Networks , Eds. Radha Poovendran, Cliff Wang, and Sumit Roy, Advances in Information Security series, vol. 30, Springer, Dec. 2006, ISBN 978-0-387-32721-1.

* cited by examiner

30

RADIO DIRECTION FINDER FOR GAMING CHIP AND/OR PLAYER TRACKING

BACKGROUND OF THE INVENTION

Various aspects of the present disclosure generally relate to RFID device tracking services implemented in table game environments.

In general, casino operators have an interest in collecting the information relating to their patrons (e.g., players). Conventionally, such information may include player tracking data and other data relating to individual player activities and/or other characteristics.

Conventionally, player tracking may be facilitated by a gaming machine and/or by a reader, such as a card reader or a radio frequency identification (RFID) reader at or near the gaming machine. In some systems, for example, a player swipes his or her player card through a reader at a gaming machine before playing a game at that machine. In other systems, for example, an RFID reader detects an RFID tag embedded within a player card.

In a typical RFID system, the RFID reader includes a microchip and an antenna that transmits electromagnetic waves in an area around the location of the reader. The RFID tag on the player card also includes a microchip and antenna. When the electromagnetic waves from the reader impact the antenna on the tag, a magnetic field is formed. The RFID tag may be passive and draw power from the magnetic field to power the microchip. An active RFID tag is powered by a battery, for example. The microchip at the RFID tag modulates the waves received from the RFID reader and transmits the modulated waves back to the reader. The reader converts the received waves into digital data identifying the tag. The reader may then transmit data to a server to track player loyalty points and/or player location in a gaming establishment.

SUMMARY OF THE INVENTION

Various aspects of the present invention are directed to different methods, systems, and computer program products for facilitating tracking locations of players and/or wireless communication devices in a casino network. In at least one embodiment, an electronically switched Doppler antenna array may be utilized to detect a first wireless signal from a first signal source. Bearing information may be generated using information from the detected signal. In at least one embodiment, the bearing information may include a first directional bearing to the first signal source. Using at least a portion of the first bearing information, a first location of the first signal source may be determined. In one embodiment, the first signal source may correspond to an RFID-enabled player tracking card, and the first location may correspond to a current, real-time location of the player tracking card. In at least one embodiment, a current location of the player tracking card may be automatically tracked in real-time as the player tracking card is moved through a first region of the casino. In another embodiment, the first signal source may correspond to an RFID-enabled gaming chip, and the first location may correspond to a current, real-time location of the gaming chip. In at least one embodiment, a current location of the gaming chip may be automatically tracked in real-time as the gaming chip is moved through a first region of the casino.

Additional objects, features and advantages of the various aspects of the present invention will become apparent from the following description of its preferred embodiments, which description should be taken in conjunction with the accompanying drawings.

DETAILED DESCRIPTION OF THE PREFERRED EMBODIMENTS

Figure 1:
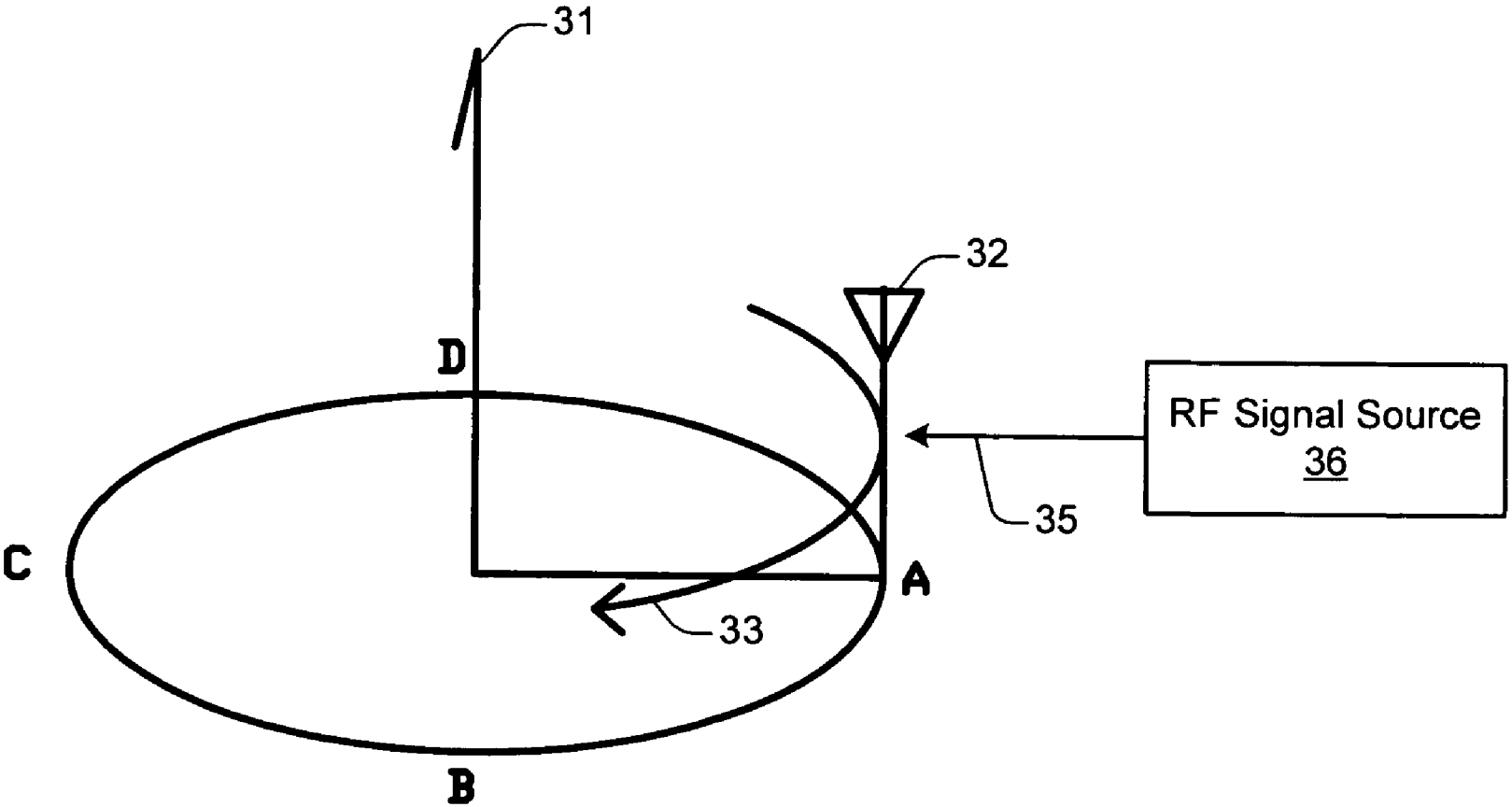
FIG. 1 shows a schematic diagram of a Doppler antenna system 30 in accordance with a specific embodiment.

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not obscure the present invention.

Example embodiments will now be described in further detail, and accompanied by the drawings. In the following description, numerous specific details are set forth in order to provide a thorough understanding of example embodiments. It will be apparent, however, to one skilled in the art, that example embodiments may be practiced without some or all of these specific details. In other instances, well known process steps and/or structures have not been described in detail in order to not obscure example embodiments.

One or more different inventions may be described in the present application. Further, for one or more of the invention(s) described herein, numerous embodiments may be described in this patent application, and are presented for illustrative purposes only. The described embodiments are not intended to be limiting in any sense. One or more of the invention(s) may be widely applicable to numerous embodiments, as is readily apparent from the disclosure. These embodiments are described in sufficient detail to enable those skilled in the art to practice one or more of the invention(s), and it is to be understood that other embodiments may be utilized and that structural, logical, software, electrical and other changes may be made without departing from the scope of the one or more of the invention(s). Accordingly, those skilled in the art will recognize that the one or more of the invention(s) may be practiced with various modifications and alterations. Particular features of one or more of the invention(s) may be described with reference to one or more particular embodiments or figures that form a part of the present disclosure, and in which are shown, by way of illustration, specific embodiments of one or more of the invention(s). It should be understood, however, that such features are not limited to usage in the one or more particular embodiments or figures with reference to which they are described. The present disclosure is neither a literal description of all embodiments of one or more of the invention(s) nor a listing of features of one or more of the invention(s) that must be present in all embodiments.

Headings of sections provided in this patent application and the title of this patent application are for convenience only, and are not to be taken as limiting the disclosure in any way.

Devices that are in communication with each other need not be in continuous communication with each other, unless expressly specified otherwise. In addition, devices that are in communication with each other may communicate directly or indirectly through one or more intermediaries.

A description of an embodiment with several components in communication with each other does not imply that all such components are required. To the contrary, a variety of optional components are described to illustrate the wide variety of possible embodiments of one or more of the invention(s).

Further, although process steps, method steps, algorithms or the like may be described in a sequential order, such processes, methods and algorithms may be configured to work in alternate orders. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the invention(s), and does not imply that the illustrated process is preferred.

When a single device or article is described, it will be readily apparent that more than one device/article (whether or not they cooperate) may be used in place of a single device/article. Similarly, where more than one device or article is described (whether or not they cooperate), it will be readily apparent that a single device/article may be used in place of the more than one device or article.

The functionality and/or the features of a device may be alternatively embodied by one or more other devices that are not explicitly described as having such functionality/features. Thus, other embodiments of one or more of the invention(s) need not include the device itself.

As explained in greater detail below, various techniques are described herein for facilitating automated player tracking techniques in live casino environments. According to specific embodiments, one or more Doppler radio direction finder device may be utilized which are capable of determining the bearings and/or distances to one or more signal sources. In one embodiment, the bearing information may be provided by an electrical switching system, and may be reported as a heading or bearing (e.g., in degrees) from the electrical switching system to the signal source(s). According to specific embodiments, the signal source(s) may be generated or transmitted by an RFID-player tracking card, RFID-enabled gaming chip, or other wireless device(s). Additionally, in at least some of embodiments, the signal strength of the received signal(s) may be used to determine a radius or distance between the signal source(s) and an antenna array of the electrical switching system. In yet other embodiments, the relative signal strength of the received signal(s) at multiple antenna arrays may be used to determine the position or location of the signal source(s).

Doppler Effect

One example of the Doppler Effect is that of a satellite transmitting an RF signal at a fixed frequency as it rotates around the earth. In this example, it is assumed that the satellite is above the earth traveling at a high rate of speed in relation to the earth's surface. As the satellite approaches a stationary antenna on the surface of the earth, the RF frequency received ($F_R$) by the stationary antenna is higher than the RF frequency transmitted ($F_T$) by the satellite. This is also true as the satellite moves away from the stationary antenna. The speed of the RF signal remains the same at about $3\times10^8$ meters per second, but the frequency received ($F_R$) by the stationary antenna increases or decreases as a function of the speed of the satellite approaching or moving away from the location of the stationary antenna.

Doppler Antenna

A similar effect occurs when an antenna is moved toward or away from a transmission source. The signal received from an antenna moving toward the transmitting source appears to be at a higher frequency than that of the actual transmitted frequency. The signal received from an antenna moving away from the transmitting source appears to be at a lower frequency than that of the actual transmission. An example of this is illustrated in FIG. 1.

FIG. 1 shows a schematic diagram of a Doppler antenna system 30 in accordance with a specific embodiment.

Referring to the example of FIG. 1, consider the antenna at position A, nearest the source of the transmission. The frequency of the received signal at position A may be substantially equal to that of the transmitted signal because, at position A, the antenna is neither moving towards nor away from the source of transmission (e.g., RF transmission source 36).

The frequency of the received signal decreases as the antenna moves from position A to position B and from position B to position C. Maximum frequency deviation occurs as the antenna passes through position B. The frequency of the received signal at position C is the same as that of the transmitted signal (e.g., no shift) because, at position C, the antenna is not moving toward or away from the source of transmission. As the antenna moves from position C to position D, and from position D back to position A, the frequency of the received signal increases. Maximum frequency deviation occurs again as the antenna passes through position D.

Generally, the Doppler frequency shift (which occurs in the above-described example of FIG. 1) may be expressed as a function of antenna rotation, according to the following expression:

$$dF=(\omega r F_T)/c \tag{1}$$

where:

dF=Peak change in frequency in Hertz (Doppler shift);

ω=Angular velocity of rotation in radians per second ($2\pi F_{rotation}$);

r=Radius of antenna rotation in meters;

$F_T$=Frequency of transmitted signal in Hertz;

c=Speed of light in meters per second;

Using Expression (1), one may derive an expression for calculating the frequency of rotation ($F_{rotation}$) of the Doppler antenna system. Thus, rearranging to get $F_{rotation}$ we get:

$$F_{rotation}=dFc/(2\pi rF_T) \quad (2)$$

$$K=c/(2\pi)=4.7746\ e7 \text{ meters per second} \quad (3)$$

$$F_{rotation}=KdF/(rF_T)\text{Hertz} \quad (4)$$

Using Expression (4) above, one may calculate a desired frequency of rotation ($F_{rotation}$) of the Doppler antenna system based, for example, on specific values for the expression variables. For example, for purposes of illustration, if it is assumed that the Doppler frequency, dF=500 Hz, the transmission frequency, $F_T$=146 e6 Hz, and the radius of the rotating antenna r=0.33 meters, the value for $F_{rotation}$ may be computed as follows:

$$F_{rotation}=KdF/(F_T r)\text{Hertz}$$

$$F_{rotation}=4.7746\ e7 \text{ meters per sec}*500 \text{ Hz}/(146\ e6 \text{ Hz}*0.33 \text{ meters}) \quad (5)$$

$$F_{rotation}=4.7746\ e7\text{per sec}*500/(146e6*0.33) \quad (6)$$

$$F_{rotation}=495.49 \text{ rotations per sec or } 29729.8 \text{ rpm} \quad (7)$$

It will be appreciated that a rotational frequency of 495.49 rotations per second may be too fast for implementation using a mechanically rotating an antenna. Accordingly, a different embodiment of a Doppler antenna system may be implemented using an electrical switching system.

Figure 2:
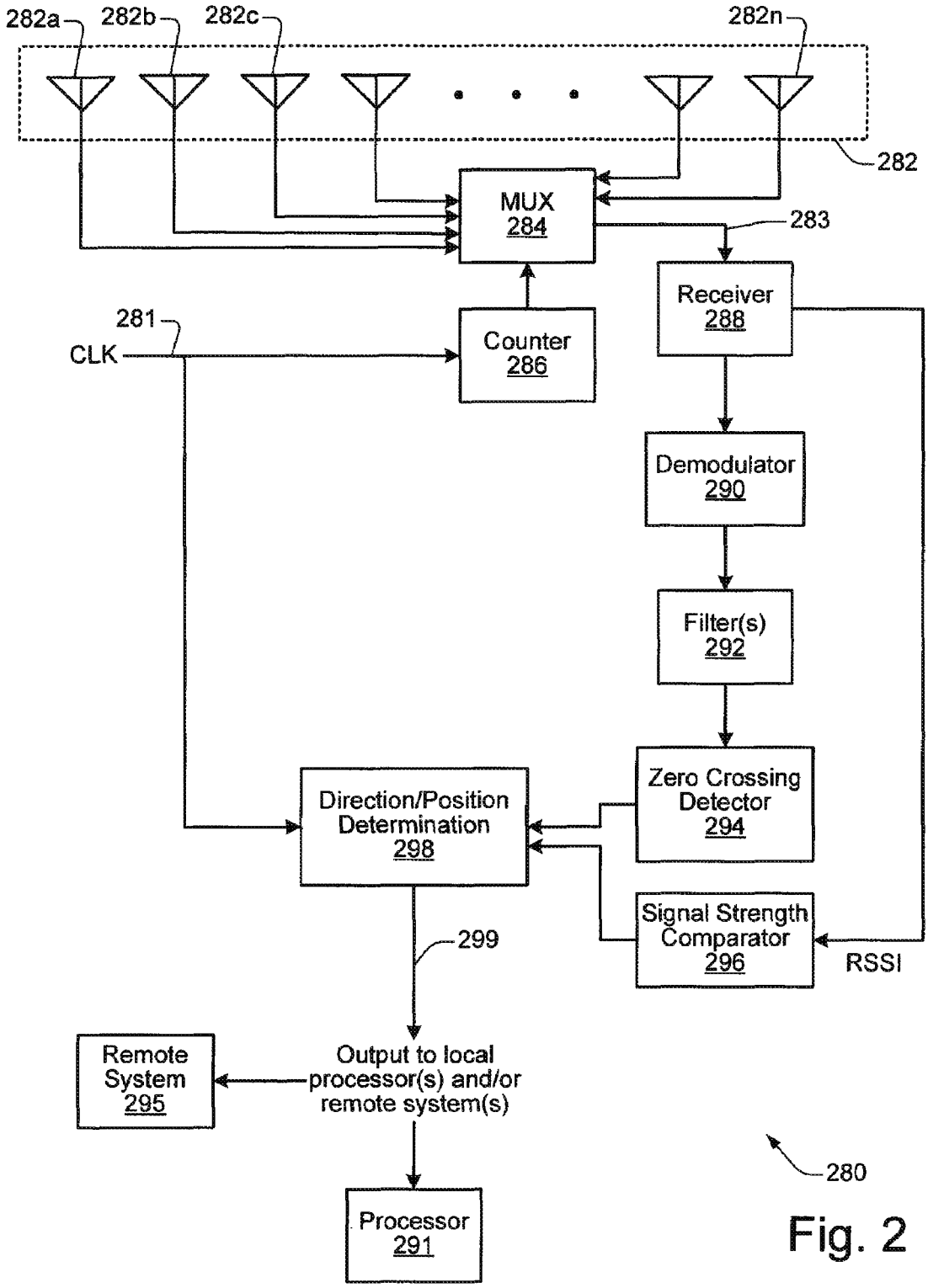
FIG. 2 shows a schematic block diagram of an example electrical switching system 280 in accordance with a specific embodiment.

FIG. 2 shows a schematic block diagram of an example electrical switching system 280 in accordance with a specific embodiment. According to at least one embodiment, electrical switching system 280 may be configured or designed to function as electrically switched Doppler antenna system (e.g., electrical Doppler radio direction finder) which, for example, may be used to stimulate, identify, and/or determine directional bearings of various wireless communication devices (WCDs) such as, for example, casino player tracking cards, gaming chips, and/or other wireless transponder devices within selected regions of the casino.

As illustrated in the example of FIG. 2, electrical switching system 280 includes an antenna array 282, which may be configured or designed to provide functionalities similar to the mechanically rotating antenna system of FIG. 1. According to specific embodiments, the antenna array may include a plurality of individual antennas 282*a-n*. The number of antennas in the antenna array 282 may vary, depending upon desired design constraints. For example, in at least some embodiments, antenna array 282 may include 6-12 antennas. In one embodiment, the antennas (e.g., 282*a-n*) of the antenna array may be arranged in a circular configuration, and sequentially activated in a desired manner which approximates a virtual rotating antenna that is rotating at a specified frequency.

According to a specific embodiment, when an RFID-enabled device (such as, for example, an RFID-enabled player tracking card or gaming chip) comes within range of the electronic switching system 280, the RFID signals transmitted from the RFID-enabled device may be received at the antenna array 282, and used to determine a directional position or location of the RFID-enabled device.

It will be appreciated that other embodiments of the electrical switching system may be configured or designed for use with other types of wireless devices, wireless signal protocols and/or wireless signal frequencies. Examples of at least some wireless protocols may include, but are not limited to, one or more of the following (or combination thereof): 802.11 (WiFi), 802.15 (including Bluetooth™), 802.16 (WiMax), 802.22, Cellular standards such as CDMA, CDMA2000, WCDMA, Radio Frequency (e.g., RFID), Infrared, Near Field Magnetic communication protocols, etc. The communication devices may transmit electrical, electromagnetic and/or optical signals which carry wireless digital data streams and/or analog signals representing various types of information.

As illustrated in the embodiment of FIG. 2, a multi-input selectable switching device (e.g., MUX) 284 may be used to selectively switch its output 283 between each of the different input antenna signals. In one embodiment, a round-robin selection scheme may be used to select each of the antennas in a sequential manner such that, over a given time period, each antenna is periodically selected at specific time intervals. In at lease one embodiment, a clock signal 281 (which, for example, may be derived using a local clock source and/or a remote clock source) and/or a counter may be used to facilitate switching activities implemented by MUX 284. It at least one embodiment, the selection/deselection of an antenna may include switching the antenna on/off at desired time intervals.

According to a specific embodiment, one or more antennas of the antenna array 282 may be configured or designed for optimal performance with respect to a specified frequency range. For example, in one embodiment, the antennas 282*a-n* may be specifically configured or designed to include features and/or characteristics which are optimal for receiving/detecting various wireless signals which may be transmitted by portable RFID devices such as, for example, RFID-enabled gaming chips and/or a player tracking cards. According to various embodiments, such signals may be within different frequency ranges and/or may be within predefined wavelength ranges such as, for example: the ultra-high frequency (UHF) range (e.g., 300-3000 MHz, 1 m-100 mm wavelength); super-high frequency (SHF) range (e.g., 3-30 GHz, 100 mm-10 mm wavelength); and/or other specifically defined frequencies or frequency ranges such as, for example: 9-135 kHz; 6.78 MHz; 13.56 MHz; 27.125 MHz; 40.680 MHz; 433.92 MHz; 869.0 MHz; 915.0 MHz; 2.45 GHz; 5.8 GHz; 24.125 GHz; etc.

According to specific embodiments, an anharmonic wireless communication technique may be used, for example, in which different signal frequencies are used to stimulate a wireless communication device and perform data communication with the wireless communication device. In at least one embodiment, the term anharmonic may refer to the use of multiple independent frequencies which are neither harmonics of each other nor sub-harmonics of each other.

For example, in at least one embodiment, the wireless communication device may correspond to an RFID-enabled device (e.g., player tracking card, gaming chip, etc.) which includes functionality for operating using one or more Near Field Magnetic communication protocols. In one embodiment, a "stimulation" signal may be transmitted to "stimulate" the RFID-enabled device to transmit a response. For example, in one embodiment, the Doppler antenna system (e.g., electrical switching system 200) may include a transmitter configured or designed to transmit magnetic energy to energize the transponder of the RFID-enabled device. In one embodiment, the frequency that provides the magnetic energy to power the transponder may be anharmonic to the frequency of the signal generated and/or transmitted by the transponder of the RFID-enabled device.

As an example, a frequency in the range of 9-135 kHz (e.g., 130.796 kHz) may be used to energize the RFID transponder of the RFID-enabled device. The transponder may be configured or designed to transmit and/or receive data via signals having a frequency of about 13.56 MHz. It is noted that the frequency of 13.56 MHz is anharmonic to the 9-135 kHz magnetic frequency. In one embodiment, the bandwidth of the receiver (e.g., 288) may be configured or designed to eliminate or filter out the lower frequencies (e.g., 9-135 kHz) that are used to energize the transponder.

According to a specific embodiment, the output of MUX 284 may include a sinusoidal modulated signal, which may be provided to receiver 288. In at least one embodiment, the receiver 288 may be configured or designed as an FM receiver which is able to receive signals within specific frequency ranges such as, for example, UHF, SHF, and/or other desired frequency ranges. In at least one embodiment, receiver 288 may be configured or designed to generate at least one output signal. For example, in one embodiment, receiver 288 may be configured or designed to generate an FM output signal within a frequency range of 280-1500 Hz.

In one embodiment, the FM output from the receiver 288 is then demodulated by demodulator 290. If desired, the modulated and/or demodulated signal(s) may also be amplified using one or more amplifiers (not shown).

As illustrated in the embodiment of FIG. 2, the output of the demodulator 290 may be processed by one or more filters 292. Examples of various filters may include, but are not limited to, one or more of the following (or combination thereof): high pass filters, low pass filters, anti-aliasing filters, bandpass filters, Butterworth filters, Chebyshev filters, Bessel filters, Finite Impulse Response (FIR) filters, Infinite Impulse Response (IIR) filters, etc. According to different embodiments, some filters may be configured to function without use of an external clock source, while other filters may be configured to function using an external clock signal or other timing reference signal.

In one example embodiment, the output of the demodulator 290 may be filtered using a high pass filter, the output from the high pass filter may then be filtered using a low pass filter, and the output from the low pass filter may then be applied to an anti-aliasing filter.

In one embodiment, the high pass filter may be configured or designed to have the following properties: 4 pole, corners at approximately 400 Hz, +20 dB gain.

In one embodiment, the low pass filter may be configured or designed to have the following properties: 8 pole, corners at approximately 500 Hz, 0 dB gain. In one embodiment, the low pass filter may be implemented using a Maxim MAX295 Butterworth switch capacitor filter. Further, in one embodiment, the low pass filter may be clocked, for example, using a 25 kHz clock signal.

In one embodiment, the anti-aliasing filter may be configured or designed to have the following properties: corner at approximately 1 KHz, 0 dB gain. According to specific embodiments, the a continuous anti-aliasing filter may be applied to other filtered output, for example, to eliminate clocking and/or switching spikes which may occur on the output of the low pass switch capacitor filter. In one embodiment, the anti-aliasing filter may be configured or designed to reduce the switching frequency of 25 KHz by −60 dB, and to reduce the output at 500 Hz to −0.3 dB.

According to specific embodiments, output from filter(s) 292 may then be provided to a zero crossing detector 294. According to a specific embodiment, the output of the zero crossing detector 294 may be provided to Direction/Position Determination component 298. In at least one embodiment, the Direction/Position Determination component 298 may be operable to utilize the information output from the zero crossing detector 294 to determine a directional position or location of the signal source (e.g., the source of signal(s) received at antenna array 282).

In at least one embodiment, electronic switching system 280 may optionally include a signal strength comparator component (e.g., 296). In one embodiment, receiver 288 may be further operable to generate an RSSI (Received Signal Strength Indicator) output which, for example, may be provided as input to the signal strength comparator component 296. In one embodiment, the output from signal strength comparator component 296 may be provided to Direction/Position Determination component 298 for use in determining a directional position or location of the signal source.

According to specific embodiments, output from the Direction/Position Determination component 298 may be provided to various local and/or remote components, devices and/or systems. For example, in one embodiment, output from the Direction/Position Determination component 298 may be provided to a local processor for further processing and analysis. In another embodiment, output from the Direction/Position Determination component 298 may be provided to a remote system (such as, for example, a player tracking system and/or gaming chip tracking system) for further processing and/or analysis.

Figure 3:
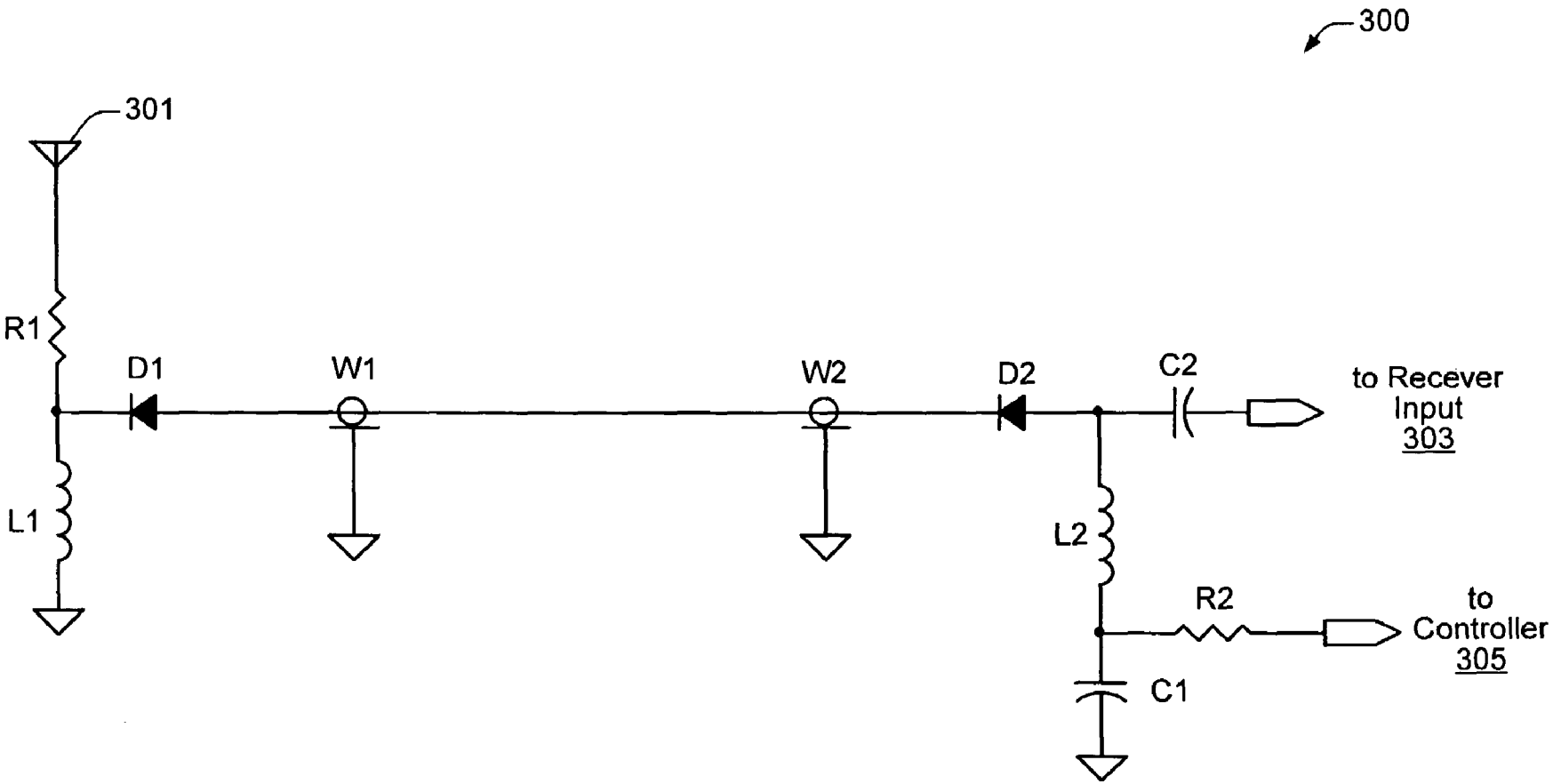
FIG. 3 shows a schematic diagram of an antenna circuit 300 having a switchable gain, in accordance with a specific embodiment.

FIG. 3 shows a schematic diagram of an antenna circuit 300 having a switchable gain, in accordance with a specific embodiment. In one embodiment, antenna array 282 of FIG. 2 may be implemented using a plurality of antenna circuits functionally similar to antenna circuit 300. According to specific embodiments, each of the antennas of the antenna array may be connected at the "to Receiver Input" line 303, but each antenna may be configured to have a separate control line 305, which, for example, may be used by MUX 284 for selectively activating/deactivating that particular antenna.

In the example embodiment of FIG. 3, specific values and/or properties associated with one or more of the various circuit elements/components may be suggested, for example, based on implementation specific details in accordance with a specific example. However, it will be appreciated that at least some of the circuit elements/components illustrated in the schematic diagrams of FIG. 3 may have associated therewith other desired values/properties, depending upon desired or preferred design criteria. Additionally, it will be appreciated that other types of circuits and/or components not illustrated in FIG. 3 may be used to implement a portion of the functional blocks/components illustrated in FIG. 2.

According to a specific embodiment, the antenna 301 may be configured as a ¼ wave dipole antenna at an operating frequency of about 433.92 MHz. The diodes D1, D2 may be implemented using a SMS3925-079 diode (see e.g., www.skyworksinc.com), and may be configured or designed to operate as low capacitance devices when they are reverse biased. For example, in one embodiment, the capacitance of each of the diodes may be about 0.48 pF when the diodes are reverse biased. The may also be configured or designed to operate as low resistance devices when forward biased.

According to a specific embodiment, other elements/components illustrated in the schematic diagram of FIG. 3 may be configured or designed to have the following properties/characteristics:

R1=50 ohm

L1, L2=0.56 uH

C1, C2=0.001 uF

R2=10k

According to specific embodiments, components W1 and W2 may include coax cables which have been configured or designed to electrically connect diodes D1 and D2. In one embodiment, the length of each cable may be determined, for example, based on a function of the radius of the antenna array. Further, in at least one embodiment, W1 and W2 may be combined into a single coax cable.

According to at least one embodiment, the antenna array 282 (FIG. 2) may include an array of n antennas arranged in a circular configuration having a radius R. According to specific embodiments, the value of the radius R may be selected to achieve desire performance characteristics of the antenna array.

Table 1 (below) shows one embodiment of a relationship between the radius of the antenna array and the change in Doppler frequency.

TABLE 1

| Doppler Frequency (Hz) | Antenna Radius (inches) | Antenna Radius (meters) |
|---|---|---|
| 499.210 | 2.770 | 0.070358141 |
| 499.570 | 2.772 | 0.070408941 |
| 499.931 | 2.774 | 0.070459741 |
| 500.291 | 2.776 | 0.070510541 |
| 500.651 | 2.778 | 0.070561341 |
| 501.012 | 2.780 | 0.070612141 |
| 501.372 | 2.782 | 0.070662941 |
| 501.733 | 2.784 | 0.070713741 |
| 502.093 | 2.786 | 0.070764542 |
| 502.454 | 2.788 | 0.070815342 |
| 502.814 | 2.790 | 0.070866142 |

According to specific embodiments, the antenna lengths may be adjusted to ¼ of a wavelength of a desired frequency, such as, for example, the transmitter frequency of a RFID device or other wireless device.

Table 2 (below) shows one embodiment of a relationship of the antenna length as a function of change in transmitter frequency.

TABLE 2

| Antenna Length (inches) | Antenna Length (meters) | Wave Length (meters) | Transmitter Frequency (Hz) |
|---|---|---|---|
| 6.867E+01 | 1.744E+00 | 6.977E+00 | 4.300E+08 |
| 6.851E+01 | 1.740E+00 | 6.961E+00 | 4.310E+08 |
| 6.835E+01 | 1.736E+00 | 6.944E+00 | 4.320E+08 |
| 6.819E+01 | 1.732E+00 | 6.928E+00 | 4.330E+08 |
| 6.804E+01 | 1.728E+00 | 6.912E+00 | 4.340E+08 |
| 6.788E+01 | 1.724E+00 | 6.897E+00 | 4.350E+08 |
| 6.772E+01 | 1.720E+00 | 6.881E+00 | 4.360E+08 |
| 6.757E+01 | 1.716E+00 | 6.865E+00 | 4.370E+08 |
| 6.741E+01 | 1.712E+00 | 6.849E+00 | 4.380E+08 |

The chart shows that the lengths of the antenna elements need to be maintained +−0.020 of an inch.

For example, in one embodiment where it is anticipated that the elliptical switching system may be used for detecting RFID signals, the circular antenna array may be configured to have a radius R=3.46 inches, with a center frequency of the antennas to 433.92 MHz. Additionally, in one embodiment, each antenna in the array may be selectively switched (e.g., switched on and off) at a frequency of 625 Hz. Such a configuration may result in a Doppler frequency output of 500 Hz at the receiver 288.

In at least one embodiment, the electrical switching system may be configured or designed to permit the eccentricity of the antenna array configuration to be within a predetermined margin of error such as, for example, within 0.005 inches (e.g., R=X+/−0.005 inches, where R is actual radius, and X is the desired radius).

In at least one embodiment, the electrical switching system may be configured or designed to permit the length of each antenna in the antenna array to be within a predetermined margin of error such as, for example, within 0.020 inches (e.g., L=X+/−0.020 inches, where L is the actual antenna length, an X is the desired antenna length).

In at least one embodiment, the overall Doppler frequency of the electrical switching system may be automatically and/or dynamically adjusted or controlled by adjusting the frequency of the clock signal (e.g., CLK 281). For example, in one embodiment where an oscillator is used to generate the clock signal, the frequency of the oscillator may be adjusted to change the Doppler frequency of the antenna array 282 and/or to change frequency-related characteristics of other components of the electrical switching system such as, for example, filter(s), etc. In this way, frequency dependent components may be allowed to track each other and/or the clock signal frequency.

According to a specific embodiment, receiver 288 may be configured or designed to generate an audio output signal within a specified frequency range such as, for example, 100-1500 Hz. In one embodiment, receiver may be implemented using an rfRXD0420/0920 receiver (see, e.g., www.microchip.com).

In at least one embodiment, receiver 288 may be operable to generate an RSSI (Received Signal Strength Indicator) output signal. In one embodiment, the RSSI output signal from the receiver may supply a voltage that is the log of the signal strength of the RF signal. The RSSI output signal may be used, for example, to determine the proper, relative and/or absolute level of the incoming signal(s) received at antenna array 282.

According to other embodiments, the RSSI signal may be used for other purposes such as, for example: to determine a distance to the signal source; to determine a location or position of the signal source; to determine whether there is sufficient signal strength of the received signal to make an accurate determination as to the direction/position of the signal source; etc.

For example, in one embodiment, the Signal Strength Comparator 296 may be operable to determine whether the signal strength indicated by the RSSI signal meets or exceeds a predetermined threshold value. If it is determined that the RSSI signal meets or exceeds a predetermined threshold value, the Signal Strength Comparator 296 may output an ENABLE signal to the Direction/Position Determination Component 298, for example, to enable operation and/or output from the Direction/Position Determination Component 298. If it is determined that the RSSI signal does not meet the predetermined threshold value, the Signal Strength Comparator 296 may output a DISABLE signal to the Direction/Position Determination Component 298, for example, to disable operation and/or output from the Direction/Position Determination Component 298.

In other embodiments, the signal strength of the received signal(s) may be used to determine a radius or distance between the signal source(s) and the antenna array 282. In yet other embodiments, the relative signal strength of the received signal(s) at multiple antenna arrays may be used to determine the position or location of the signal source(s).

According to a specific embodiment, the Signal Strength Comparator 296 may include at least one input device to allow dynamic adjustment of the comparator threshold. In one embodiment, the comparator threshold may be adjusted, for example, from 0 mV to about 200 mV. Further, in a specific embodiment, the input RSSI signal may be within the range of approximately 40 μV to 160 mV.

According to specific embodiments, Zero Crossing Detector 294 may be configured or designed as a non-inverting comparator that is centered around a predetermined voltage (e.g., +2.5 volts).

For example, in one embodiment, the output of filter block 292 may be centered at about 2.5 volts, and may swing both positive and/or negative. Hysteresis may be accomplished with a resister that provides positive feedback. A state change from low to high indicates the positive going zero crossing point. A high to low transition indicates the negative going zero crossing point.

According to specific embodiments, the electrical switching system 280 may be configured or designed to as a Doppler radio direction finder device capable of determining the directions to one or more signal sources. In one embodiment, the directional information provided by electrical switching system 280 may be reported as a heading or bearing (e.g., in degrees) from the electrical switching system 280 to the signal source. In one embodiment, the signal source may be generated or transmitted by an RFID-player tracking card, RFID-enabled gaming chip, or other wireless device(s).

According to specific embodiments, the radio direction finding techniques described herein may be combined with the use of triangulation to determine (e.g., in real-time) the position or location of one or more wireless communication devices (WCDs) within desire regions of the casino.

Generally, triangulation is the process of finding a distance to a point by calculating the length of one side of a triangle, given measurements of angles and sides of the triangle formed by that point and at least two other reference points.

For example, in at least one embodiment, multiple Doppler radio direction finder devices (such as, for example, electrical switching system 280) may be deployed at known locations within desired regions of the casino. By stimulating RFID-enabled device(s) within those regions to transmit signals, the Doppler radio direction finder devices may be used to calculate the exact location of the RFID-enabled devices within those regions.

This may be useful for monitoring the flow of people and/or gaming chips within a casino. It may also be useful for monitoring the movements of individual gaming chips and/or persons (such as, for example, an employee, a player, a guest, a service person, and/or any other person caring an RFID player tracking card or other RFID-enabled device).

Further, the various techniques described herein may also be useful for monitoring the movements or locations of other items within a casino such as, for example, coin carts, service carts, mobile gaming devices, RFID-enable devices, cell phones, PDAs, etc.

Figure 4:
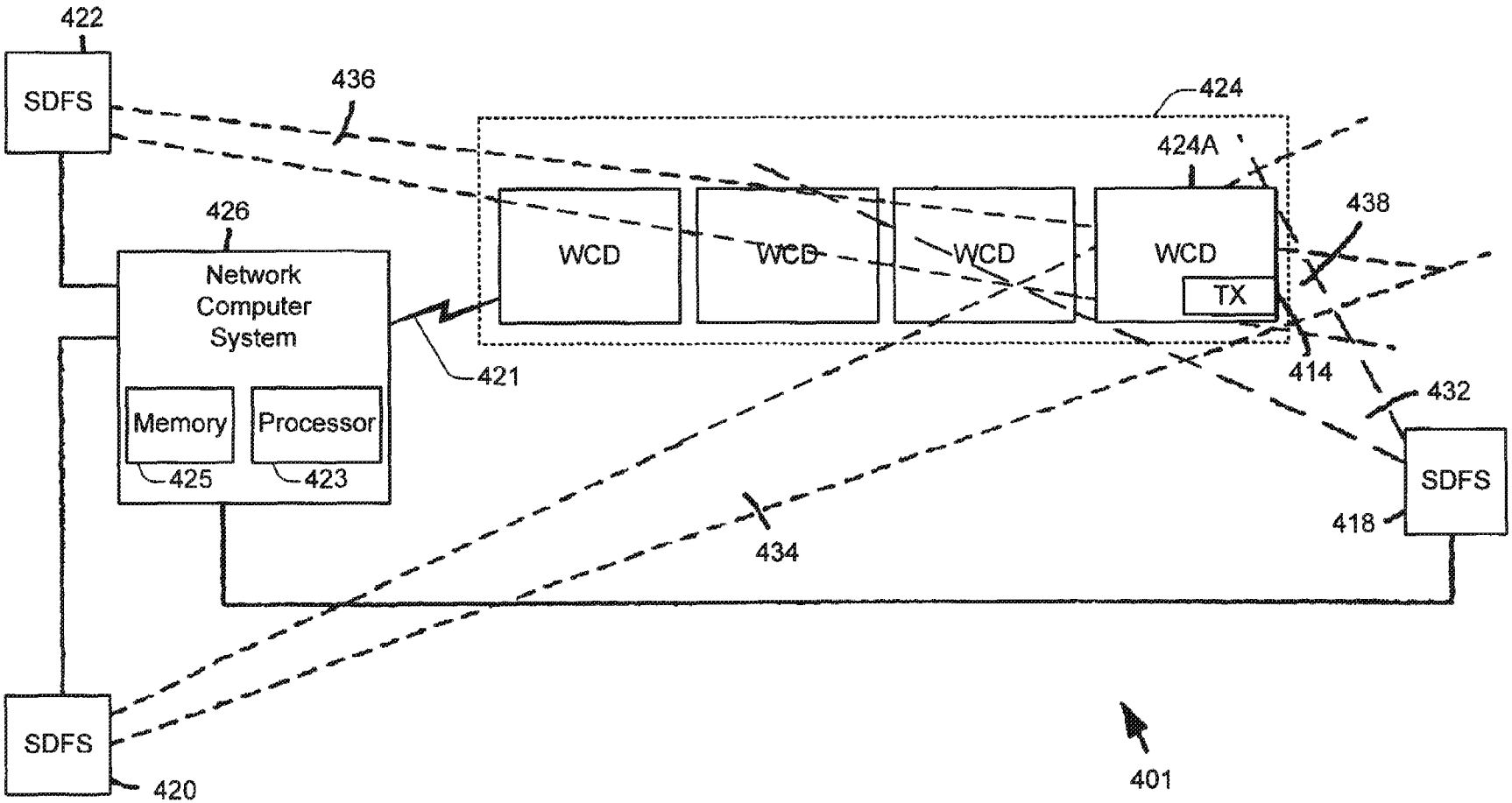
FIG. 4 shows an example of a specific embodiment of a casino gaming system 401 which may be used for tracking the location and/or movements of wireless communication devices.

FIG. 4 shows an example of a specific embodiment of a casino gaming system 401 which may be used for tracking the location and/or movements of wireless communication devices.

As shown in FIG. 4, a plurality of wireless communication devices (WCDs) 424 are shown within a casino gaming system 401. According to specific embodiments, the plurality of wireless communication devices 424 may include one or more different types mobile or portable devices which are capable of engaging in wireless communication with at least one other device of the casino gaming system or network. Examples of such wireless communication devices may include, but are not limited to, one or more of the following (and/or combination thereof): RFID-enabled communication devices (e.g., RFD-enabled player tracking cards, RFID-enabled gaming chips, etc.); wireless gaming devices; PDAs; cell phones; etc.

In at least one embodiment, one or more of the wireless communication devices may be communicatively coupled (e.g., via at least one wireless communication link 421 to a network computer system 426. According to specific embodiments, one or more communication interfaces may be utilized having different architectures and utilizing a variety of protocols such as, for example: 802.11 (WiFi), 802.15 (including Bluetooth™), 802.16 (WiMax), 802.22, Cellular standards such as CDMA, CDMA2000, WCDMA, Radio Frequency (e.g., RFID), Infrared, Near Field Magnetic communication protocols, etc. The communication links may transmit electrical, electromagnetic or optical signals which carry digital data streams and/or analog signals representing various types of information.

According to specific embodiments, the network computer system 426 is further communicatively coupled with one or more signal direction finder devices (SDFSs), such as, for example, signal direction finder devices 418, 420 and 422. It will be appreciated that the three signal direction finder devices illustrated in FIG. 4 represents an example of one specific embodiment. Other embodiments of the casino gaming system may include greater/fewer signal direction finder devices than that illustrated in the example of FIG. 4.

In at least one embodiment, at least some of the signal direction finder devices may be implemented using a Doppler radio direction finder device which includes an electrically switched antenna array and/or other components of the electrical switching system(s) described, for example, with respect to FIGS. 2 and 3 of the drawings.

In at least one embodiment, each of the signal direction finder devices 418, 420, 422 of FIG. 4 is capable of receiving wireless communications signals transmitted by one or more of the WCDs 424. In at least one embodiment, at least some of the WCDs may include a respective transmitter or transponder (e.g., 414) for transmitting wireless signals to one or more components/devices of the casino gaming system 401.

Operation of the gaming system 401 will now be described by way of illustration with reference to WCD Location Procedure 500 of FIG. 5.

Figure 5:
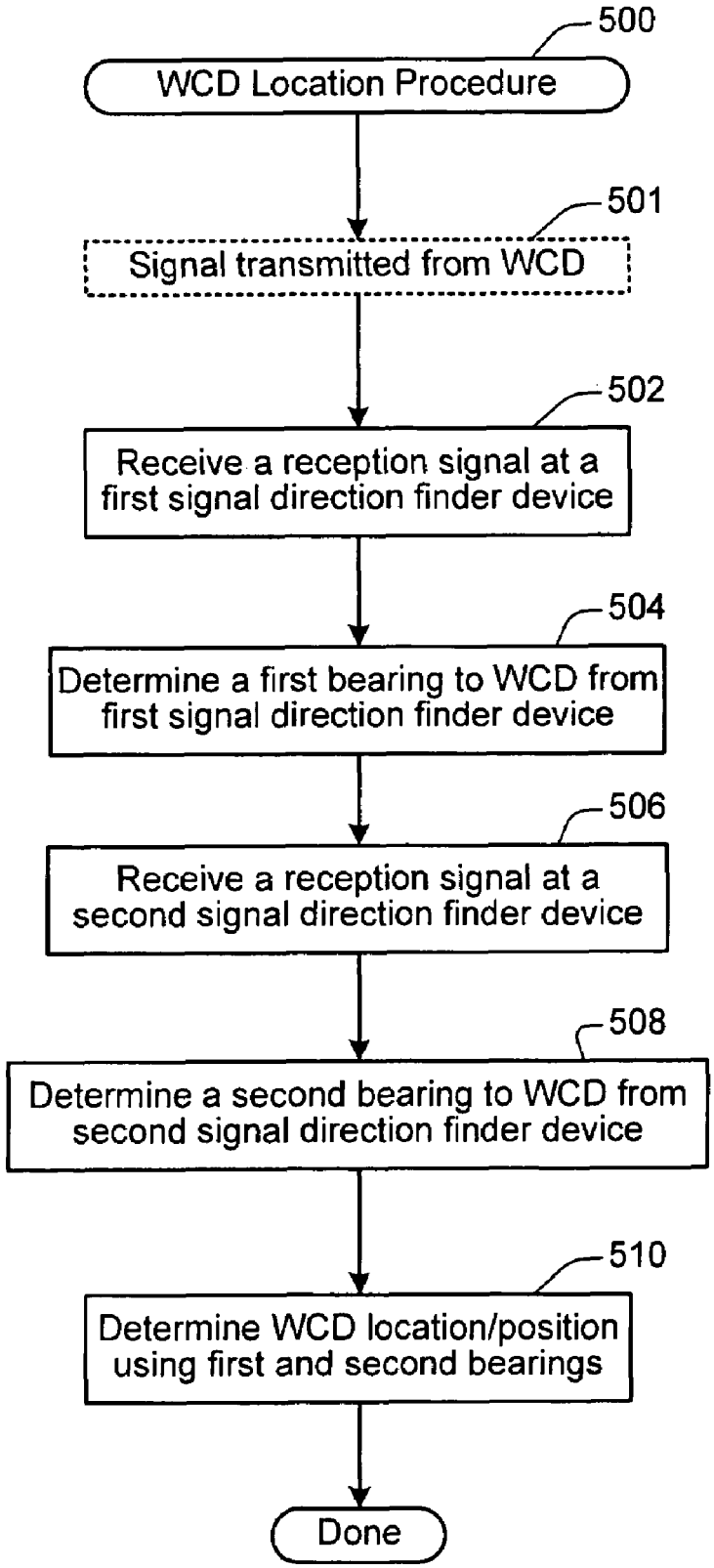
FIG. 5 shows a flow diagram of a wireless communication device (WCD) Location Procedure 500 in accordance with a specific embodiment.

FIG. 5 shows a flow diagram of a wireless communication device (WCD) Location Procedure 500 in accordance with a specific embodiment. In at least one embodiment, at least a portion of the WCD Location Procedure 500 of FIG. 5 may be implemented at one or more components/devices of casino gaming system 401.

Referring to FIG. 5, at 501 it is assumed that at least one event/condition has occurred to cause one of the wireless communication devices (e.g., 424A) to transmit a wireless signal. For example, in one embodiment, the WCD may correspond to a RFID-enabled player tracking card which has been stimulated (e.g., by one or more of the signal direction finder devices) to transmit an RFID signal via transponder 414.

As explained in greater detail below, one or more of the signal direction finder devices may receive and process the signal transmitted by WCD 424A in order to determine a relative direction of the signal source, which may then be communicated to one or more components of the casino gaming system such as, for example, network computer system 426.

For example, as illustrated in FIG. 5, the wireless signal from WCD 424A may be received (502) at a first signal direction finder device (e.g., 418, FIG. 4). A first bearing 432 from the first signal direction finder device to the signal source (e.g., WCD 424A) may be determined (504). In at least one embodiment, the first bearing may be determined using an electrical switching system (such as that illustrated, for example, in FIG. 2) which has been configured or designed to include Doppler radio direction determination functionality.

As shown at 506, the wireless signal from WCD 424A may also be received (506) at a second signal direction finder device (e.g., 420, FIG. 4). A second bearing 434 from the second signal direction finder device to the signal source (e.g., WCD 424A) may be determined (508).

As shown at 510, the location or position of the signal source (e.g., WCD 424A) may be determined, for example, using at least a portion of the first bearing and second bearing information. In at least one embodiment, the first bearing and second bearing information may be transmitted to a remote system (e.g., network computer system 426) for processing, and the remote system may be operable to use at least a portion of the first bearing and second bearing information to determine or compute the location or position of the signal source (e.g., WCD 424A). In at least one embodiment, at least a portion of these operations may be performed in real-time, thereby allowing the location and/or movements of the WCD device(s) to be tracked in real-time. Additionally, according to specific embodiments, gaming system 401 may be operable to simultaneously and/or concurrently track the individual location/movements of a plurality of different WCDs within given region(s) of the casino.

According to a specific embodiment, the network computer system 426 (and/or other devices of the gaming network) may be capable of determining the location/position of the signal source (e.g., WCD 424A) utilizing the first and second bearings 432 and 434 by determining a bearing intersection 438 where the first and second bearing regions 432 and 434 intersect.

In at least one embodiment, the location of the bearing intersection 438 (which corresponds to the location of the wireless communication device 424A), may be determined using a map of the casino represented as a coordinate system. Each wireless communication device 424 may have associated therewith a respective location on the coordinate system represented by positional coordinates. According to different embodiments, the positional coordinates may correspond to a Cartesian coordinate system, a polar coordinate system, or any other coordinate system capable of describing the location of the wireless communication device(s) 424 in the casino. In at least one embodiment, the known positions of one or more signal direction finder devices may also be represented on the casino coordinate system as positional coordinates.

According to specific embodiments, the location(s)/movement(s) of one or more of the wireless communication device(s) may be stored at one or more devices/systems of the gaming network, such as, for example, player tracking system(s), gaming chip tracking system(s), security system(s), accounting system(s), promotion system(s), etc.

In at least some embodiments, the wireless signal(s) from WCD 424A may also be received at other signal direction finder device (e.g., 422, FIG. 4), whereupon additional bearing(s) (e.g., 436) to the signal source may be determined and used, for example, in determining the location or position of the signal source.

It will be appreciated that other techniques may also be used for detecting and/or Tracking the locations(s) of player tracking cards and/or gaming chips which are capable of wireless communication. Examples of such other techniques may include, but are not limited to, one or more of the following (or combination thereof): bearing determination techniques such as, for example, signal triangulation using an array of 2 or more antennas/receivers; time-of-arrival techniques; signal strength techniques; device proximity detection techniques; etc.

For example, some embodiments, the signal strength of the received signal(s) may be used to determine a range or distance between the signal source(s) and the antenna array (e.g., 282). According to different embodiments, a variety of different algorithms may be used for calculating or determining range estimates based on received signal strength data. Examples of at least some of such algorithms are described in one or more of the references cited below. In at least some embodiments, range estimation may be facilitated where the source signal strength is either known or predetermined. According to a specific embodiment, a single electrical switching system (such as that illustrated, for example, in FIG. 2) may be used to generate both estimated range information and bearing information relating to a selected signal source. The estimated range information may be analyzed along with the bearing information in order to calculate or determine a location (e.g., absolute and/or relative location) of the selected signal source. In other embodiments, the relative signal strength of the received signal(s) at multiple antenna arrays may be used to determine the position or location of the signal source(s).

Additional details relating to various aspects of signal strength range estimation and signal source location are described in one or more of the following references, each of which is incorporated herein by reference in its entirety for all purposes:

U.S. Pat. No. 7,116,987, by Spain, Jr., et al., entitled "LOCATION ESTIMATION OF WIRELESS TERMINALS THROUGH PATTERN MATCHING OF DEDUCED AND EMPIRICAL SIGNAL-STRENGTH MEASUREMENTS", issued on Oct. 3, 2006;

U.S. Pat. No. 7,116,988, by Dietrich, et al., entitled "LOCATION OF WIRELESS NODES USING SIGNAL STRENGTH WEIGHTING METRIC", issued on Oct. 3, 2006;

N. Patwari, A. O. Hero and J. Costa, "Learning Sensor Location from Signal Strength and Connectivity," in *Secure Localization and Time Synchronization for Wireless Sensor and Ad Hoc Networks*, Eds. Radha Poovendran, Cliff Wang, and Sumit Roy, Advances in Information Security series, Vol. 30, Springer, December 2006, ISBN 978-0-387-32721-1.

Other System Embodiments

Figure 6:
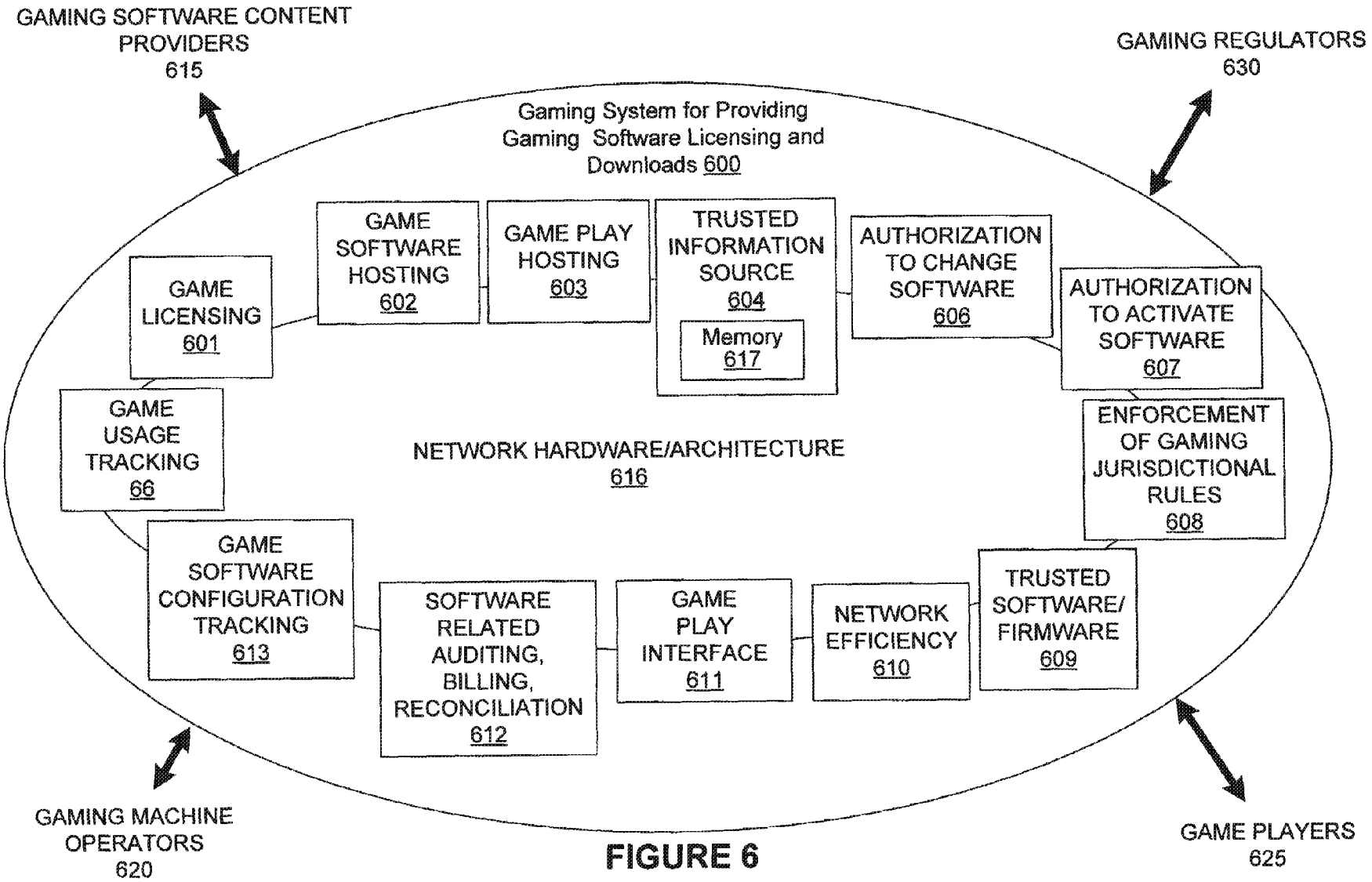
FIG. 6 is a block diagram of a gaming system of a specific example of an embodiment.

FIG. 6 shows a block diagram illustrating components of a gaming system 600 which may be used for implementing various aspects of example embodiments. In FIG. 6, the components of a gaming system 600 for providing game software licensing and downloads are described functionally. The described functions may be instantiated in hardware, firmware and/or software and executed on a suitable device. In the system 600, there may be many instances of the same function, such as multiple game play interfaces 611. Nevertheless, in FIG. 6, only one instance of each function is shown. The functions of the components may be combined. For example, a single device may comprise the game play interface 611 and include trusted memory devices or sources 609.

The gaming system 600 may receive inputs from different groups/entities and output various services and or information to these groups/entities. For example, game players 625 primarily input cash or indicia of credit into the system, make game selections that trigger software downloads, and receive entertainment in exchange for their inputs. Game software content providers provide game software for the system and may receive compensation for the content they provide based on licensing agreements with the gaming machine operators. Gaming machine operators select game software for distribution, distribute the game software on the gaming devices in the system 600, receive revenue for the use of their software and compensate the gaming machine operators. The gaming regulators 630 may provide rules and regulations that must be applied to the gaming system and may receive reports and other information confirming that rules are being obeyed.

In the following paragraphs, details of each component and some of the interactions between the components are described with respect to FIG. 6. The game software license host 601 may be a server connected to a number of remote gaming devices that provides licensing services to the remote gaming devices. For example, in other embodiments, the license host 601 may 1) receive token requests for tokens used to activate software executed on the remote gaming devices, 2) send tokens to the remote gaming devices, 3) track token usage and 4) grant and/or renew software licenses for software executed on the remote gaming devices. The token usage may be used in utility based licensing schemes, such as a pay-per-use scheme.

In another embodiment, a game usage-tracking host 615 may track the usage of game software on a plurality of devices in communication with the host. The game usage-tracking host 615 may be in communication with a plurality of game play hosts and gaming machines. From the game play hosts and gaming machines, the game usage tracking host 615 may receive updates of an amount that each game available for play on the devices has been played and on amount that has been wagered per game. This information may be stored in a database and used for billing according to methods described in a utility based licensing agreement.

The game software host 602 may provide game software downloads, such as downloads of game software or game firmware, to various devious in the game system 600. For example, when the software to generate the game is not available on the game play interface 611, the game software host 602 may download software to generate a selected game of chance played on the game play interface. Further, the game software host 602 may download new game content to a plurality of gaming machines via a request from a gaming machine operator.

In one embodiment, the game software host 602 may also be a game software configuration-tracking host 613. The function of the game software configuration-tracking host is to keep records of software configurations and/or hardware configurations for a plurality of devices in communication with the host (e.g., denominations, number of paylines, paytables, max/min bets). Details of a game software host and a game software configuration host that may be used with example embodiments are described in co-pending U.S. Pat. No. 6,645,077, by Rowe, entitled, "Gaming Terminal Data Repository and Information System," filed Dec. 21, 2000, which is incorporated herein in its entirety and for all purposes.

A game play host device 603 may be a host server connected to a plurality of remote clients that generates games of chance that are displayed on a plurality of remote game play interfaces 611. For example, the game play host device 603 may be a server that provides central determination for a bingo game play played on a plurality of connected game play interfaces 611. As another example, the game play host device 603 may generate games of chance, such as slot games or video card games, for display on a remote client. A game player using the remote client may be able to select from a number of games that are provided on the client by the host device 603. The game play host device 603 may receive game software management services, such as receiving downloads of new game software, from the game software host 602 and may receive game software licensing services, such as the granting or renewing of software licenses for software executed on the device 603, from the game license host 601.

In particular embodiments, the game play interfaces or other gaming devices in the gaming system 600 may be portable devices, such as electronic tokens, cell phones, smart cards, tablet PC's and PDA's. The portable devices may support wireless communications and thus, may be referred to as wireless mobile devices. The network hardware architecture 616 may be enabled to support communications between wireless mobile devices and other gaming devices in gaming system. In one embodiment, the wireless mobile devices may be used to play games of chance.

The gaming system 600 may use a number of trusted information sources. Trusted information sources 604 may be devices, such as servers, that provide information used to authenticate/activate other pieces of information. CRC values used to authenticate software, license tokens used to allow the use of software or product activation codes used to activate to software are examples of trusted information that might be provided from a trusted information source 604. Trusted information sources may be a memory device, such as an EPROM, that includes trusted information used to authenticate other information. For example, a game play interface 611 may store a private encryption key in a trusted memory device that is used in a private key-public key encryption scheme to authenticate information from another gaming device.

When a trusted information source 604 is in communication with a remote device via a network, the remote device will employ a verification scheme to verify the identity of the trusted information source. For example, the trusted information source and the remote device may exchange information using public and private encryption keys to verify each other's identities. In another example of an embodiment, the remote device and the trusted information source may engage in methods using zero knowledge proofs to authenticate each of their respective identities. Details of zero knowledge proofs that may be used with example embodiments are described in US publication no. 2003/0203756, by Jackson, filed on Apr. 25, 2002 and entitled, "Authentication in a Secure Computerized Gaming System, which is incorporated herein in its entirety and for all purposes.

Gaming devices storing trusted information might utilize apparatus or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected.

The gaming system 600 of example embodiments may include devices 606 that provide authorization to download software from a first device to a second device and devices 607 that provide activation codes or information that allow downloaded software to be activated. The devices, 606 and 607, may be remote servers and may also be trusted information sources. One example of a method of providing product activation codes that may be used with example embodiments is describes in previously incorporated U.S. Pat. No. 6,264,561.

A device 606 that monitors a plurality of gaming devices to determine adherence of the devices to gaming jurisdictional rules 608 may be included in the system 600. In one embodiment, a gaming jurisdictional rule server may scan software and the configurations of the software on a number of gaming devices in communication with the gaming rule server to determine whether the software on the gaming devices is valid for use in the gaming jurisdiction where the gaming device is located. For example, the gaming rule server may request a digital signature, such as CRC's, of particular software components and compare them with an approved digital signature value stored on the gaming jurisdictional rule server.

Further, the gaming jurisdictional rule server may scan the remote gaming device to determine whether the software is configured in a manner that is acceptable to the gaming jurisdiction where the gaming device is located. For example, a maximum bet limit may vary from jurisdiction to jurisdiction and the rule enforcement server may scan a gaming device to determine its current software configuration and its location and then compare the configuration on the gaming device with approved parameters for its location.

A gaming jurisdiction may include rules that describe how game software may be downloaded and licensed. The gaming jurisdictional rule server may scan download transaction records and licensing records on a gaming device to determine whether the download and licensing was carried out in a manner that is acceptable to the gaming jurisdiction in which the gaming device is located. In general, the game jurisdictional rule server may be utilized to confirm compliance to any gaming rules passed by a gaming jurisdiction when the information needed to determine rule compliance is remotely accessible to the server.

Game software, firmware or hardware residing a particular gaming device may also be used to check for compliance with local gaming jurisdictional rules. In one embodiment, when a gaming device is installed in a particular gaming jurisdiction, a software program including jurisdiction rule information may be downloaded to a secure memory location on a gaming machine or the jurisdiction rule information may be downloaded as data and utilized by a program on the gaming machine. The software program and/or jurisdiction rule information may used to check the gaming device software and software configurations for compliance with local gaming jurisdictional rules. In another embodiment, the software program for ensuring compliance and jurisdictional information may be installed in the gaming machine prior to its shipping, such as at the factory where the gaming machine is manufactured.

The gaming devices in game system 600 may utilize trusted software and/or trusted firmware. Trusted firmware/software is trusted in the sense that is used with the assumption that it has not been tampered with. For instance, trusted software/firmware may be used to authenticate other game software or processes executing on a gaming device. As an example, trusted encryption programs and authentication programs may be stored on an EPROM on the gaming machine or encoded into a specialized encryption chip. As another example, trusted game software, i.e., game software approved for use on gaming devices by a local gaming jurisdiction may be required on gaming devices on the gaming machine.

In example embodiments, the devices may be connected by a network 616 with different types of hardware using different hardware architectures. Game software can be quite large and frequent downloads can place a significant burden on a network, which may slow information transfer speeds on the network. For game-on-demand services that require frequent downloads of game software in a network, efficient downloading is essential for the service to viable. Thus, in example embodiments, network efficient devices 610 may be used to actively monitor and maintain network efficiency. For instance, software locators may be used to locate nearby locations of game software for peer-to-peer transfers of game software. In another example, network traffic may be monitored and downloads may be actively rerouted to maintain network efficiency.

One or more devices in example embodiments may provide game software and game licensing related auditing, billing and reconciliation reports to server 612. For example, a software licensing billing server may generate a bill for a gaming device operator based upon a usage of games over a time period on the gaming devices owned by the operator. In another example, a software auditing server may provide reports on game software downloads to various gaming devices in the gaming system 600 and current configurations of the game software on these gaming devices.

At particular time intervals, the software auditing server 612 may also request software configurations from a number of gaming devices in the gaming system. The server may then reconcile the software configuration on each gaming device. In one embodiment, the software auditing server 612 may store a record of software configurations on each gaming device at particular times and a record of software download transactions that have occurred on the device. By applying each of the recorded game software download transactions since a selected time to the software configuration recorded at the selected time, a software configuration is obtained. The software auditing server may compare the software configuration derived from applying these transactions on a gaming device with a current software configuration obtained from the gaming device. After the comparison, the software-auditing server may generate a reconciliation report that confirms that the download transaction records are consistent with the current software configuration on the device. The report may also identify any inconsistencies. In another embodiment, both the gaming device and the software auditing server may store a record of the download transactions that have occurred on the gaming device and the software auditing server may reconcile these records.

There are many possible interactions between the components described with respect to FIG. 6. Many of the interactions are coupled. For example, methods used for game licensing may affect methods used for game downloading and vice versa. For the purposes of explanation, details of a few possible interactions between the components of the system 600 relating to software licensing and software downloads have been described. The descriptions are selected to illustrate particular interactions in the game system 600. These descriptions are provided for the purposes of explanation only and are not intended to limit the scope of example embodiments described herein.

Techniques and mechanisms of embodiments described herein may sometimes be described in singular form for clarity. However, it should be noted that particular embodiments include multiple iterations of a technique or multiple instantiations of a mechanism unless noted otherwise.

Additional details relating to various aspects of device tracking in a casino network are described in U.S. Pat. No. 6,923,724, by Richard Williams, entitled "GAMING SYSTEM ALLOWING LOCATION DETERMINATION OF A GAMING UNIT IN A CASINO", issued on Aug. 2, 2005, the entirety of which is incorporated herein by reference for all purposes.

Although several preferred embodiments of this invention have been described in detail herein with reference to the accompanying drawings, it is to be understood that the invention is not limited to these precise embodiments, and that various changes and modifications may be effected therein by one skilled in the art without departing from the scope of spirit of the invention as defined in the appended claims.

The invention claimed is:

1. A system for facilitating tracking locations of players and/or wireless communication devices in a casino network, the system comprising:

a first processor;

memory;

at least one interface; and a first antenna array including a first antenna and a second antenna;

the system being operable to:

detect, at the first antenna array, a first wireless signal from a first signal source, wherein the detecting comprises receiving the first wireless signal at the first antenna at a first time T1 and receiving the first wireless signal at the second antenna at a second time T2;

detect a change in frequency of the first wireless signal using information relating to the wireless signal received at times T1 and T2;

generate, using information relating to the change in frequency of the first wireless signal, first bearing information which includes a first directional bearing to the first signal source; and determine, using at least a portion of the first bearing information, a first location of the first signal source.

2. The system of claim 1 wherein the first signal source corresponds to a RFID-enabled player tracking card.

3. The system of claim 1 wherein the first signal source corresponds to a RFID-enabled player tracking card, the system being further operable to:

automatically track, in real-time, a current location of the player tracking card as the player tracking card is moved through a first region of the casino.

4. The system of claim 1 wherein the first signal source corresponds to a RFID-enabled gaming chip.

5. The system of claim 1 wherein the first signal source corresponds to a RFID-enabled gaming chip, the system being further operable to:

automatically track, in real-time, a current location of the gaming chip as the gaming chip is moved through a first region of the casino.

6. The system of claim 1 wherein the first signal source corresponds to a mobile wireless communication device.

7. The system of claim 1 wherein the first antenna array is configured or designed to function as an electrically switched Doppler antenna system.

8. The system of claim 1 being further operable to:

determine first received signal strength data relating to the received first signal;

determine, using the first received signal strength data, first range data relating to a first estimated range or distance to the first signal source; and determine, using at least a portion of the first bearing information and first range data, the first location of the first signal source.

9. A method for facilitating tracking locations of players and/or wireless communication devices in a casino network, the method comprising:

detecting, at a first Doppler antenna array including a first antenna and a second antenna, a first wireless signal from a first signal source, the first signal source corresponding to a first mobile wireless communication device, wherein detecting the first wireless signal from the first signal source comprises receiving the first wireless signal at the first antenna at a first time T1 and receiving the first wireless signal at the second antenna at a second time T2;

detecting a change in frequency of the first wireless signal using information relating to the wireless signal received at times T1 and T2;

generating, using information relating to the change in frequency of the first wireless signal, first bearing information which includes a first directional bearing to the first signal source;

determining, using at least a portion of the first bearing information, a first location of the first signal source; and automatically tracking, in real-time, a current location of the first wireless communication device as the first wireless communication device is moved through a first region of the casino.

10. The method of claim 9 wherein the first wireless communication device corresponds to an RFID-enabled player tracking card.

11. The method of claim 9 wherein the first wireless communication device corresponds to an RFID-enabled gaming chip.

12. A system for facilitating tracking locations of players and/or wireless communication devices in a casino network, the system comprising:

means for detecting, at a first antenna array, a first wireless signal from a first signal source, the first signal source corresponding to a first mobile wireless communication device;

means for generating first bearing information which includes a first directional bearing to the first signal source;

means for detecting, at a second antenna array, the first wireless signal from the first signal source;

means for generating second bearing information which includes a second directional bearing to the first signal source;

means for determining, using at least a portion of the first and second bearing information, a first location of the first signal source, wherein the first location corresponds to a current, real-time location of the first wireless communication device; and means for automatically tracking, in real-time, a current location of the first wireless communication device as the first wireless communication device is moved through a first region of the casino.

13. The system of claim 12 wherein the first wireless communication device corresponds to an RFID-enabled player tracking card.

14. The system of claim 12 wherein the first wireless communication device corresponds to an RFID-enabled gaming chip.

15. A system for facilitating tracking locations of players and/or wireless communication devices in a casino network, the system comprising:

a first processor;

memory;

at least one interface;

a first antenna array; and a second antenna array;

the system being operable to:

detect, at the first antenna array, a first wireless signal from a first signal source;

generate first bearing information which includes a first directional bearing to the first signal source;

detect, at the second antenna array, the first wireless signal from the first signal source;

generate second bearing information which includes a second directional bearing to the first signal source; and determine, using at least a portion of the first and second bearing information, the first location of the first signal source.

16. The system of claim 15, the system being further operable to:

automatically track, in real-time, the signal source as the signal source is moved through a first region of the casino.

17. The system of claim 15, wherein the first signal source corresponds to a RFID-enabled player tracking card.

18. The system of claim 15, wherein the first signal source corresponds to a RFID-enabled gaming chip.

19. The system of claim 15, wherein the first signal source corresponds to a mobile wireless communication device.

20. A system for facilitating tracking locations of players and/or wireless communication devices in a casino network, the system comprising:

a first processor;

memory;

at least one interface; and a first antenna array including a first antenna;

the system being operable to:

receive, at the first antenna array, a first wireless signal from a first signal source;

determine first received signal strength data relating to the received first signal;

determine, using the first received signal strength data, first range data relating to a first estimated range or distance to the first signal source;

generate first bearing information which includes a first directional bearing to the first signal source; and determine, using at least a portion of the first bearing information and first range data, a first location of the first signal source.

21. The system of claim 20, the system being further operable to:

automatically track, in real-time, the signal source as the signal source is moved through a first region of the casino.

22. The system of claim 20, wherein the first signal source corresponds to a RFID-enabled player tracking card.

23. The system of claim 20, wherein the first signal source corresponds to a RFID-enabled gaming chip.

24. The system of claim 20, wherein the first signal source corresponds to a mobile wireless communication device.

25. A method for facilitating tracking locations of players and/or wireless communication devices in a casino network, the method comprising:

detecting, at a first Doppler antenna array, a first wireless signal from a first signal source, the first signal source corresponding to a first mobile wireless communication device;

generating first bearing information which includes a first directional bearing to the first signal source;

detecting, at a second Doppler antenna array, the first wireless signal from the first signal source;

generating second bearing information which includes a second directional bearing to the first signal source;

determining, using at least a portion of the first and second bearing information, a first location of the first signal source; and automatically tracking, in real-time, a current location of the first wireless communication device as the first wireless communication device is moved through a first region of the casino.

26. The method of claim 25 wherein the first wireless communication device corresponds to an RFID-enabled player tracking card.

27. The method of claim 25 wherein the first wireless communication device corresponds to an RFID-enabled gaming chip.

28. A method for facilitating tracking locations of players and/or wireless communication devices in a casino network, the method comprising:

receiving, at a first antenna of a first Doppler antenna array, a first wireless signal from a first signal source, the first signal source corresponding to a first mobile wireless communication device;

determining first received signal strength data relating to the received first signal;

determining, using the first received signal strength data, first range data relating to a first estimated range or distance to the first signal source;

generating first bearing information which includes a first directional bearing to the first signal source;

determining, using at least a portion of the first bearing information and first range data, a first location of the first signal source; and automatically tracking, in real-time, a current location of the first wireless communication device as the first wireless communication device is moved through a first region of the casino.

29. The method of claim 28 wherein the first wireless communication device corresponds to an RFID-enabled player tracking card.

30. The method of claim 28 wherein the first wireless communication device corresponds to an RFID-enabled gaming chip.

31. A system for facilitating tracking locations of players and/or wireless communication devices in a casino network, the system comprising:

a first processor;

memory;

at least one interface; and a first antenna array;

a second antenna array;

means for detecting a first wireless signal from a first signal source, the first signal source corresponding to a first mobile wireless communication device, wherein the detecting comprises receiving the first wireless signal at a first antenna array at a first time T1 and receiving the first wireless signal at a second antenna array at a second time T2;

means for detecting a change in frequency of the first wireless signal using information relating to the wireless signal received at times T1 and T2;

means for generating, using information relating to the change in frequency of the first wireless signal, first bearing information which includes a first directional bearing to the first signal source;

means for determining, using at least a portion of the first bearing information, a first location of the first signal source; and means for automatically tracking, in real-time, a current location of the first wireless communication device as the first wireless communication device is moved through a first region of the casino.

32. The system of claim 31 wherein the first wireless communication device corresponds to an RFID-enabled player tracking card.

33. The system of claim 31 wherein the first wireless communication device corresponds to an RFID-enabled gaming chip.

34. A system for facilitating tracking locations of players and/or wireless communication devices in a casino network, the system comprising:

a first processor;

memory;

at least one interface;

a first antenna array; and a second antenna array;

means for receiving, at the first antenna array, a first wireless signal from a first signal source, the first signal source corresponding to a first mobile wireless communication device;

means for determining first received signal strength data relating to the received first signal;

means for determining, using the first received signal strength data, first range data relating to a first estimated range or distance to the first signal source;

means for generating first bearing information which includes a first directional bearing to the first signal source;

means for determining, using at least a portion of the first bearing information and first range data, a first location of the first signal source; and means for automatically tracking, in real-time, a current location of the first wireless communication device as the first wireless communication device is moved through a first region of the casino.

35. The system of claim 34 wherein the first wireless communication device corresponds to an RFID-enabled player tracking card.

36. The system of claim 34 wherein the first wireless communication device corresponds to an RFID-enabled gaming chip.

37. The system of claim 1 wherein T1 is substantially equal to T2.

38. The method of claim 9 wherein T1 is substantially equal to T2.

39. The system of claim 31 wherein T1 is substantially equal to T2.

* * * * *